US005960488A

United States Patent [19]

Morris

[11] Patent Number: 5,960,488

[45] Date of Patent: Oct. 5, 1999

[54] LIFT CHAIR FOR A MECHANICAL LIFT

[76] Inventor: Edward J. Morris, 3236 Patterson Rd., Bay City, Mich. 48706

[21] Appl. No.: 08/708,426

[22] Filed: Sep. 5, 1996

Related U.S. Application Data

[63] Continuation-in-part of application No. 08/386,986, Jan. 19, 1995, abandoned.

[51] Int. Cl.[6] ..... E04H 4/00

[52] U.S. Cl. ..... 4/496; 472/119

[58] Field of Search ..... 4/496, 560.1, 561.1, 4/562.1, 563.1, 564.1, 565.1, 566.1; 442/118, 119; 5/81.1, 83.1, 84.1, 85.1, 86.1; 414/921; 105/149, 149.1, 149.2

[56] References Cited

U.S. PATENT DOCUMENTS

| | | | |
|---|---|---|---|
| 1,300,680 | 4/1919 | Wilson | 472/119 |
| 2,844,187 | 7/1958 | Scoville | 105/149.2 X |
| 3,137,245 | 6/1964 | Spector | 105/149.2 X |
| 3,170,412 | 2/1965 | Sowder | 105/149.2 X |
| 4,569,091 | 2/1986 | Brandenberger | 4/562.1 |
| 4,606,082 | 8/1986 | Kuhlman | 4/561.1 |
| 4,928,330 | 5/1990 | Moore | 4/562.1 |
| 5,376,053 | 12/1994 | Ponder et al. | 472/119 |

*Primary Examiner*—Robert M. Fetsuga
*Attorney, Agent, or Firm*—Robert L. Mc Kellar

[57] ABSTRACT

This specification deals with a device which is a novel lift chair for use in a mechanical lift for moving an invalid or handicapped person from a poolside into a pool, and back to the poolside, wherein the invalid or handicapped person may be totally responsible for such movement without the aid of a second person by the use of a control unit which is affixed to the lift chair and is conveniently operable from such chair.

19 Claims, 5 Drawing Sheets

LIFT CHAIR FOR A MECHANICAL LIFT

This application is a continuation-in-part application of patent application Ser. No. 08/386,986, filed on Jan. 19, 1995, now abandoned.

The invention disclosed and claimed herein deals with a device which is a novel lift chair for use in a mechanical lift for moving an invalid or handicapped person from a poolside into a pool, and back to the poolside, wherein the invalid or handicapped person may be totally responsible for such movement without the aid of a second person.

More specifically, this invention deals with a lift chair which allows independent movement into and out of a pool of water, when used with a mechanical lift device. The lift chair is designed such that it has an control device which immediately operates a shaft brake to allow control of the stopping and starting of the lift chair by the person seated in the lift chair.

In addition, the lift chair of this invention has other novel features.

BACKGROUND

In U.S. patent application Ser. No. 08/210,626, filed on Mar. 18, 1994, entitled "AN INDEPENDENT LIFT", naming the inventor of the invention described herein, now U.S. Pat. No. 5,383,238, issued Jan. 24, 1995, there is disclosed a device for moving an invalid or handicapped person from a poolside into a pool. The invention disclosed therein deals with a motorized mechanical device which allows independent movement into and out of a pool of water, which device may or may not be under the control of the invalid or handicapped person, and a device in which there is enhanced security for the invalid or handicapped person from falling, or slipping from the support of the device, or being immersed in the pool water for a time longer than desired, or for a depth that is not desired, or from being moved to dangerous heights above the poolside in order to accommodate the movements of the device, and which allows for the mounting of the device from the back of the device which is away from the edge of the pool, and which provides a barrier to accidental slippage into the pool.

In that application, Morris describes a portion of the inventive device as a "support device", which is a generic term for a chair to support a human form.

As described therein, the chair is a "sling" type chair, in that, it is suspended from a supporting shaft of the lifting device, rather than being fixed to a support column or the like.

This invention deals with a novel sling type lift chair that is useful in the independent lifting device, wherein the chair is easily controlled by the person suspended in the lift device, and wherein that person has intimate control over the entire movement of the lift chair.

PRIOR ART

Aside from the sling type chair described in the pending application described above, the inventor is aware of one other similar sling type chair which is not really a sling type, but is suspended.

Such a chair can be found in U.S. Pat. No. 4,606,082 to Kuhlman, which issued on Aug. 19, 1986. This chair is suspended on a hydraulic rod which allows for the raising or lowering of the chair, which rod is in turn attached to a set of tracks which extend to and from a restricted area, such as a bathtub, to a non-restricted area.

This type of chair does not rotate around a lifting bar and thus the lift chair of the instant invention could not be adapted to the device described therein. Further, the lift chair of the instant invention does not require all of the elaborate hydraulic and electrical equipment required to operate the Kuhlman device.

THE INVENTION

The invention herein deals with a novel lift chair which is useful in a motorized independent lift apparatus. With regard to the Figures in which like or equivalent elements have like numbers, and with special reference to FIG. 8, there is shown one embodiment of this invention which is a lift chair which comprises a frame, wherein the frame has two spaced-apart, generally upwardly extending shafts, each said shaft having an upper end, a lower end, and a front side.

Each upper end of the shafts terminates in a tee, wherein each tee has a top, wherein the top of each tee is a hollow tubular bearing housing with each bearing housing being capable of having a tubular bearing retained therein.

There is also a seat and each lower end of the upwardly extending shafts terminates in a horizontal bar arrangement and they are attached to each other at their terminating ends to form a support for the seat which is surmounted thereon.

Further, there is a back support means and the lower ends of the upwardly extending shafts have mounted therebetween, a common back support means attached to their respective front sides.

Finally, there is an electrical control connected to a power cord wherein the electrical control is attached to the upwardly extending shafts by a support cord which support cord and power cord each have a sufficient length to allow a person seated in the seat to use the control.

An optional embodiment of this first description of the invention is a lift chair as disclosed above in which the hollow tubular bearing housing contains a non-conductive tubular bearing therein. This embodiment can also have additionally mounted on the front face of its respective upwardly extending shafts, a trapeze bar wherein the trapeze bar has a U-shaped configuration and has upper ends on the U which are rigidly attached to the upwardly extending shafts to provide support for the trapeze bar.

With reference to FIG. 9, there is shown a second type of lift chair of this invention which is a chair comprising in addition to the parts set forth above, a common supporting shaft having outer ends which are capable of being rigidly supported, which common supporting shaft extends through and outside the ends of each of the tubular bearing housings such that there can be mounted thereon at least one shaft mounted brake, said shaft mounted brake comprising a brake assembly comprising in combination, a housing for the brake assembly having an outside surface, an electromagnetic magnet assembly, and a means of energizing and controlling the electromagnetic magnet.

In the brake assembly, there is a first metal plate having a center opening and a metal bearing having an outside surface.

The brake assembly is supported on a second supporting plate, which supporting plate is adapted with a center opening through which the support shaft passes. The second supporting plate has an outside edge, an outer face and an inner face and has an outside dimension greater than the outside dimension of the brake assembly. The second metal supporting plate has an opening through it near its outside edge.

The first metal plate is fixedly attached to a collar, which collar passes through the center opening in the first metal plate, and the collar is fixedly attached to the supporting shaft.

The collar has rotatably mounted thereon, the metal bearing, which metal bearing is surrounded on its outside surface and rotatably interfaces with an electromagnetic magnet. The electromagnetic magnet is rigidly supported on the inner face of the first supporting plate and the supporting shaft is sealed against water penetration at the outer face of the second supporting plate and the outside surface of the brake assembly housing.

The first supporting plate is rigidly connected to an upwardly extending shaft by a connecting rod such that the rod extends between the upwardly extending shaft and the second supporting plate, wherein the rod is affixed to the first supporting plate by a detachable connector, which detachable connector passes through the opening near the outside edge of the second supporting plate and into the rod. The rod and second supporting plate have a non-conductive gasket between them. The detachable connector and the second supporting plate also have a non-conductive gasket between them and the detachable connector is surrounded by a non-conductive sleeve as it passes through the opening near the outside edge of the second supporting plate. This embodiment can optionally have the hollow tubular bearing housing containing a non-conductive tubular bearing therein and/or the trapeze as discussed above.

FIG. 10 shows an embodiment of this invention which is a lift chair which does not have the control as shown in FIG. 8, but instead has a safety bar.

A further embodiment of this invention is shown in FIG. 11, comprising all of the parts described above such as the control 67, the brake 18, the safety bar 34. The safety bar has a U-shaped configuration with lower and upper ends wherein each said upper end is fixedly mounted on each respective support handle. The safety bar has mounted between the lower ends thereof, a float, which float is capable of floating in water and supporting the safety bar. This further embodiment can optionally have associated with it the non-conductive bearing and/or the trapeze discussed above.

Still further, and with reference to FIG. 12, there is another embodiment of this invention in which all of the above parts, except the hanging control 67, can be used in addition to an electrical control which is attached to the safety bar, said electrical control being capable of being connected electrically with a power source.

Finally, with reference to FIG. 13, there is included within the scope of this invention, a lift chair having all of the above parts combined together, said chair comprising a frame, wherein said frame has two spaced-apart, generally upwardly extending shafts. Each said shaft has an upper end, a lower end, and a front side and each upper end terminates in a tee. Each of the tees has a top, wherein the top of each tee is a hollow tubular bearing housing. The bearing housing contains therein a bearing and located within the bearing, a non-conductive tubular rod which has two outside ends, and generally runs the distance of the length of the housing.

There is also a common supporting shaft having outer ends which are capable of being rigidly supported, said common supporting shaft extending through to the outside ends of each of the sleeves. The support shaft has mounted thereon, at least one shaft mounted brake having an inner face, said inner face having a plate rigidly mounted thereon. The plate has an outer face and an inner face and said plate conforms essentially to the dimensions of the inner face of the brake. The plate is detachedly fixed on its outer face to a rigid second shaft by a bolt having a shank and a head, said rigid second shaft being fixedly attached to the upper end of one of the upwardly extending shafts at a point below the tee. There is present between the bolt head and the inner face of the plate, a non-conducting gasket which surrounds said bolt, and, there is also present between the outer face of the plate and the rigid second shaft a second, non-conducting gasket surrounding the bolt.

In addition, there is a seat, with each lower end of the upwardly extending shafts terminating in a horizontal bar arrangement and being attached to each other at their terminating ends to form a support for the seat, which is surmounted thereon.

Also, there is a back support means wherein each lower end of the upwardly extending shafts has a common back support means attached to their respective front sides. Each upwardly extending shaft has mounted on its front side, at a convenient point above the horizontal bar arrangement, a support handle, said support handle being fixedly attached thereto.

Also included is a safety bar. The safety bar has a U-shaped configuration and has upper ends on the U. Each upper end is rotatably mounted on each respective support handle.

Further, there is a trapeze bar, the trapeze bar has a U-shaped configuration and has upper ends on the U, each said upper end being rigidly mounted on the front face of its respective upwardly extending shafts.

The combination further includes an electrical control attached to the safety bar, and thus, one must utilize the safety bar in order to access the control, said electrical control being connected electrically with the brake and the power to the lift. The control controls the start and stop of said brake and allows for control of the movement of the chair thereby.

The device of this invention, equipped with an electromagnetic shaft brake as described herein, when used with an independent lifting device, allows for a smooth transition from a stopping or starting movement.

Further, the device is protected from electrical shock owing to the novel bearings, with tubular rods, and the use of non-conductive gasketing, described herein.

In addition, the lift chair of this invention may contain as a part of this invention, a new and novel non-pinching connector device that is useful for connecting the safety bar to the upwardly extending shafts, which connector allows the lifting and lowering of the safety bar without causing any pinch points for the human body.

Such novel connector comprises in combination a connector handle, a connector housing, and an axle. The connector handle comprises a wheel wherein the wheel has an outside edge and a center hole and, a brace. The brace has a front end and a back end and has essentially a U-shaped configuration.

The brace is integrally connected at the back end with a portion of the outside edge of the wheel. The wheel has an elongated opening through it which has a long center axis, which opening extends from the outside edge of the wheel essentially at the point where the brace is connected to the wheel, to the opposite outside edge of the wheel.

The brace has an elongated opening through it which has a long center axis. This opening extends from the front end of the brace through the back end of the brace.

The elongated openings are aligned through their long center axis and the elongated openings are capable of receiving a common shaft.

The connector housing has a forward hollow compartment with a top edge, a solid back end, and separated side walls. The solid back end has a vertical concave surface to allow for mating with a vertical shaft and the solid back end has at least one opening, but preferably there are two such openings, one located near the bottom of the housing and the other near the top of the housing. The openings accommodate fasteners for fastening the connector housing to a vertical shaft.

The forward compartment has circular openings through the side walls near the top edge, which circular openings are in alignment with each other.

The connector handle and the connector housing are rotatably mounted with one another by inserting the wheel into the forward compartment between the separated side walls and aligning the center hole of the wheel with the circular openings of the connector housing and inserting the axle through said circular openings and center hole.

One does not have to worry about the maintenance of hydraulics with the device of this invention.

Thus, it is one object of this invention to provide a device which enhances the use of an independent lift, which device can be operated solely by the person deriving the benefits of the device, without the intervention or help of a second party.

It is a further object of this invention to provide a device that will be safe to use, especially in an aqueous environment such as a pool and surrounding poolside, such that the device will move an invalid or handicapped person from the poolside into a pool, allow the immersion of the invalid or handicapped person to a desirable depth in the pool water, and then allow that person to safely move back to the poolside, all in relative safety.

It is yet another object of this invention to provide a device that has low maintenance, will not provide potential problems with the environment through the use and disposal of hydraulic fluids, and which will allow a handicapped or invalid person to utilize in relative safety because of the control over the lifting chair that can be exerted by the person using the chair.

DETAILED DESCRIPTION OF THE INVENTION

The detailed description of the invention will deal with a lift chair which has been provided with all of the embodiments of this invention and it should be understood that such references will also include like parts and points on all of the embodiments of this invention.

Figure 1:
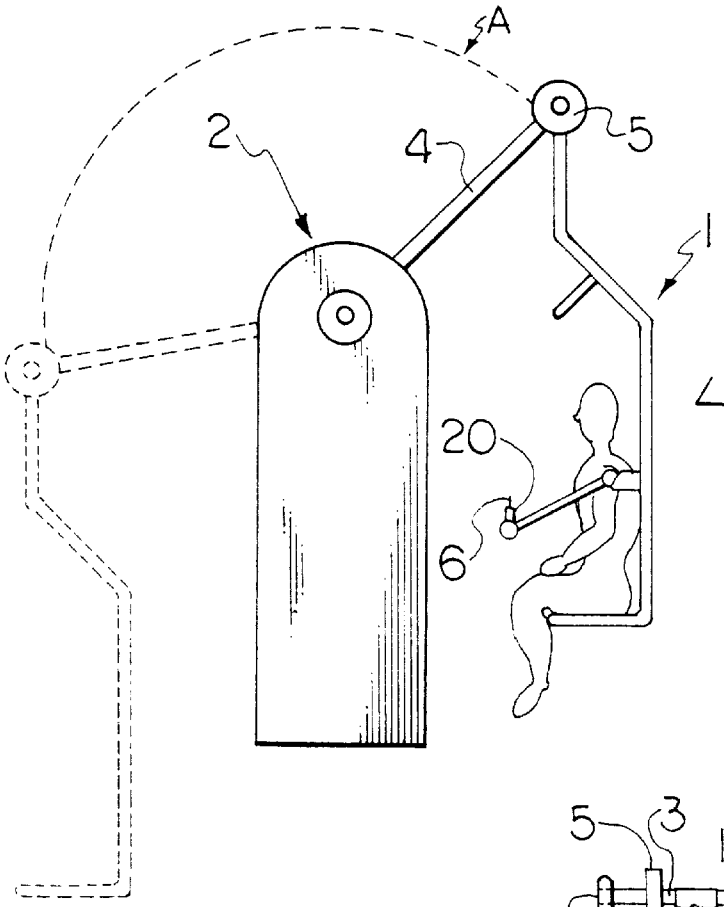
FIG. 1 is a full side view of an independent lift showing one inventive lift chair of this invention in conjunction with such independent lift. There is further shown the relative movement of the lift chair by dotted lines.
Figure 2:
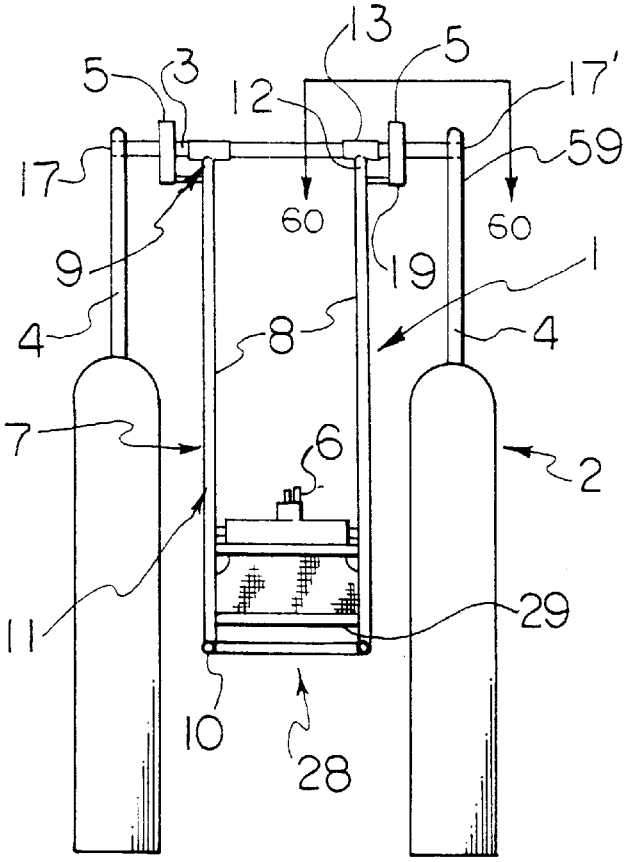
FIG. 2 is a full front view of a lift chair and lift of FIG. 1.

Therefore, with reference to FIG. 1, there is shown a full side view of a device of this invention in combination with a lift 2, and in FIG. 2, there is shown a full front view of a device of this invention in combination with a lift 2, which is a sling type chair 1. It is shown attached to a supporting shaft 3 (FIG. 2) carried by a pair of swinging arms 4 using the lift 2, it being understood that the lift 2 does not form any part of the invention claimed herein.

As is illustrated in FIG. 1, the lift chair 1 is moved by the lift 2 by a motion provided by the arms 4 which are powered by a drive chain mechanism (not shown), such that the chair 1 moves forward and backward through a low level arc more or less illustrated by the dashed line A. The lift 2 and the swinging arms 4 do not form part of the instant invention and are shown to more clearly illustrate the relationship of the lift chair 1 to the lift 2.

The support shaft 3 is equipped with at least one shaft brake 5 (two such brakes are shown herein) and a control mechanism 6 for the lift 2 and the brakes 5, all of which will be described in more detail infra.

Figure 3:
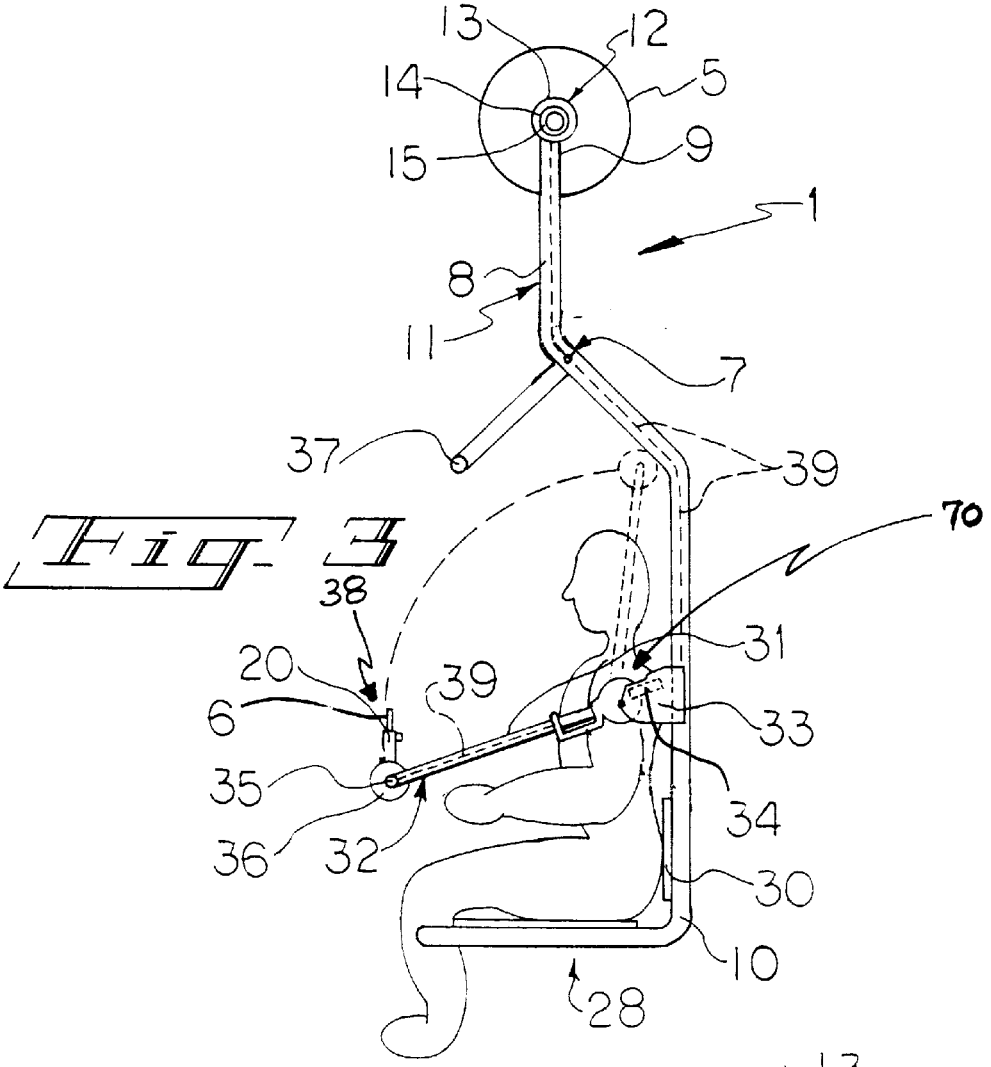
FIG. 3 is an enlarged, full side view of the lift chair of this FIG. 1.

With reference to FIG. 3, there is shown an enlarged full side view of the lift chair 1, with a human figure seated therein.

In FIGS. 2 and 3, the lift chair 1 is comprised of a frame, generally shown at 7. The frame 7 consists of two spaced apart, generally upwardly extending shafts 8, each of which are equipped with an upper end 9, a lower end 10, and a front side 11.

Figure 4:
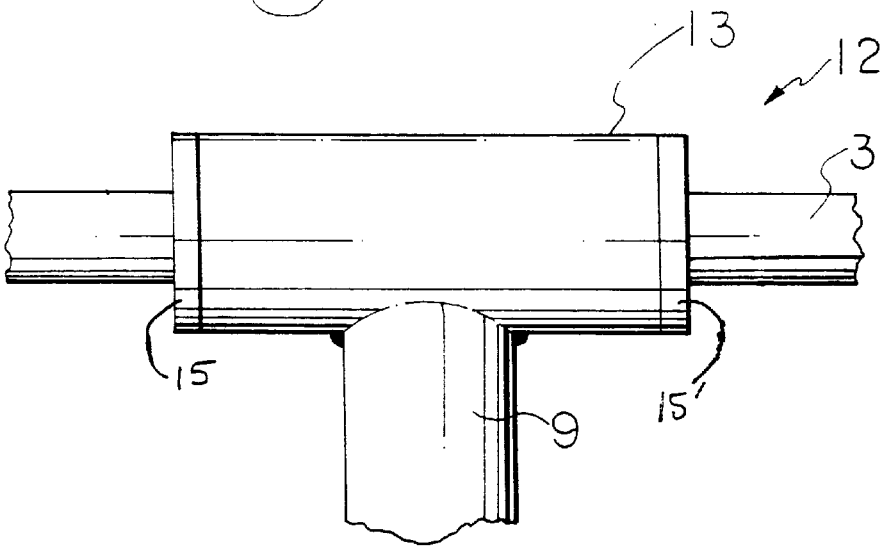
FIG. 4 is an enlarged front view of a bearing housing of the top end of an upwardly extending shaft of certain inventive lift chairs herein.
Figure 5:
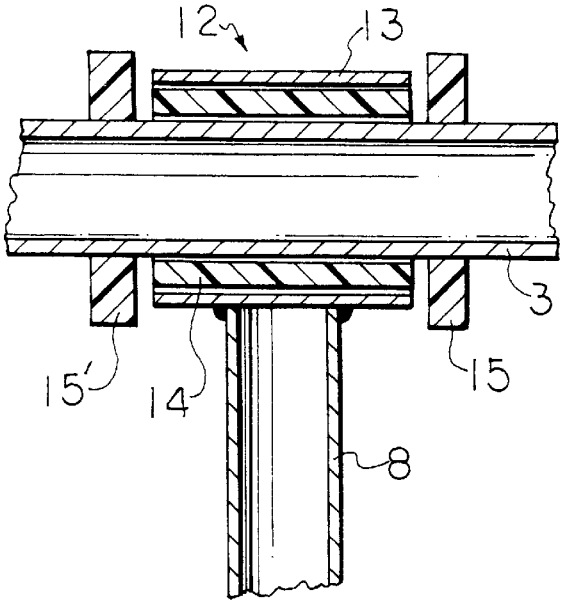
FIG. 5 is an enlarged cross-sectional view of the bearing housing of FIG. 4 taken through the line 50—50.
Figure 6:
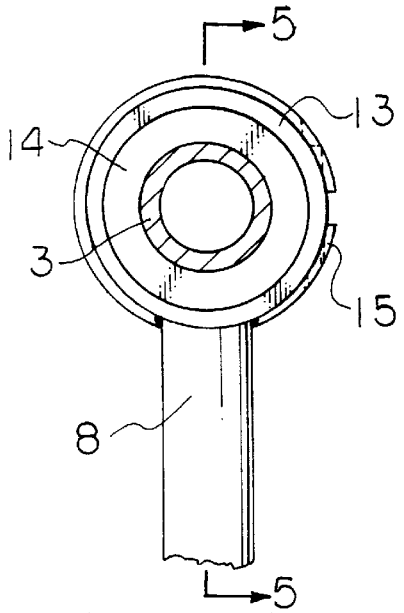
FIG. 6 is an enlarged end view of the bearing housing of FIG. 4.

Each of the upper ends 9 terminate in a tee configuration 12 shown in FIG. 4, and shown in a cross-sectional front view in FIG. 5, which cross-section is taken through line 50—50 of FIG. 4. Each of the Tees 12 has a top which is a hollow tubular bearing housing 13 and located within the hollow tubular bearing housing 13 is a non-conductive bearing 14. The bearing 14 is held in place, for example, retainer rings 15 and 15'.

With regard to FIG. 2, there is shown a supporting shaft 3 which is common to both lifting arms 4, which supporting shaft is supported at its outer ends 17 and 17' by the lifting arms 4.

Figure 7:
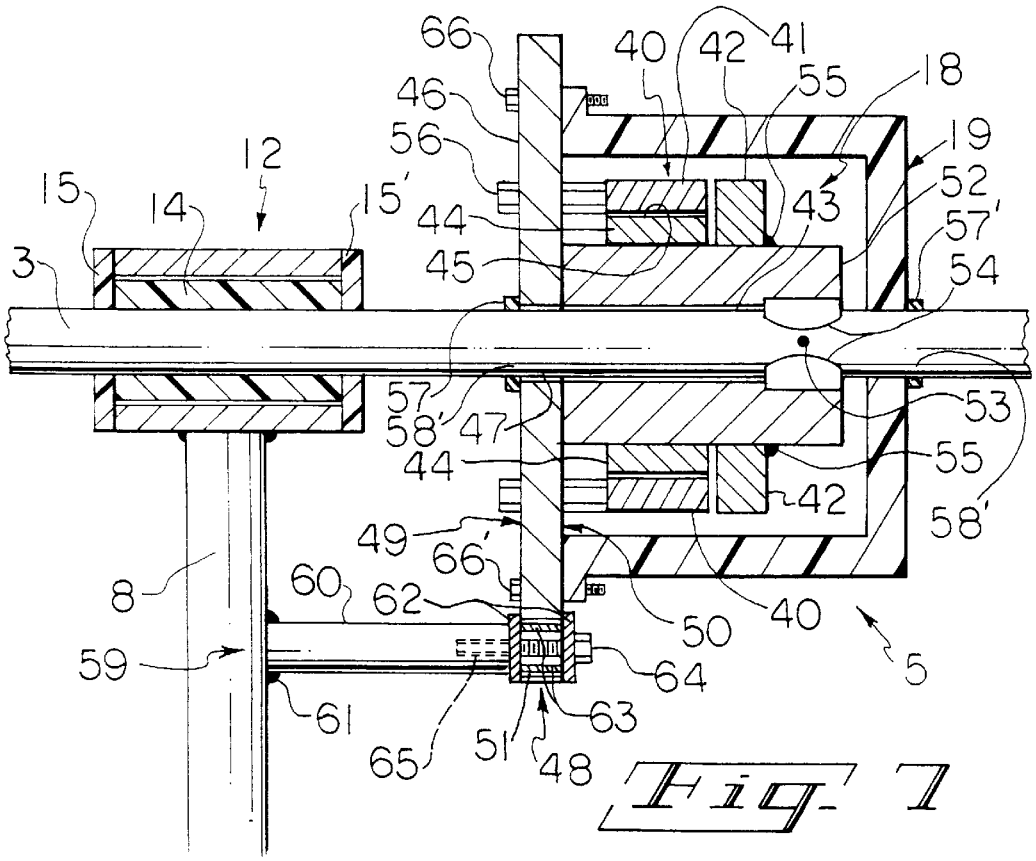
FIG. 7 is an enlarged cross-sectional view and detail of that portion of the lift chair of FIG. 2 through the line designated 60—60.
Figure 8:
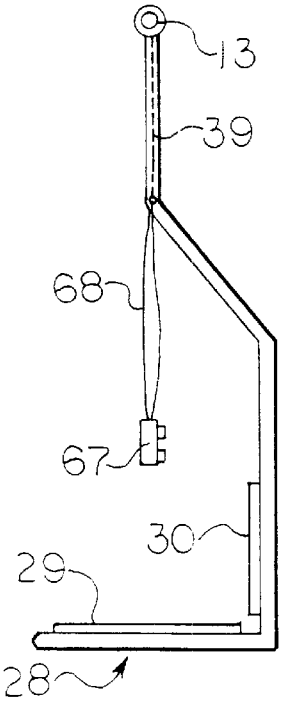
FIG. 8 is a side view of a lift chair of this invention not showing a brake or safety bar.
Figure 9:
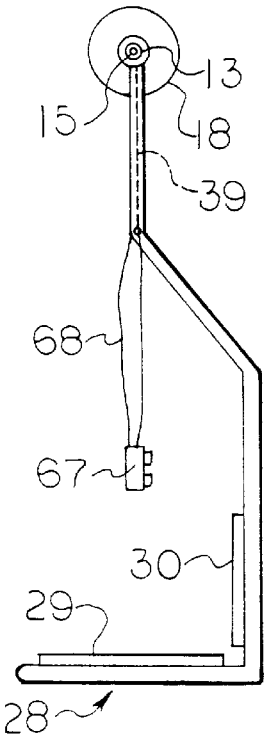
FIG. 9 is a side view of a lift chair of this invention showing a brake assembly and a hanging electrical control.
Figure 10:
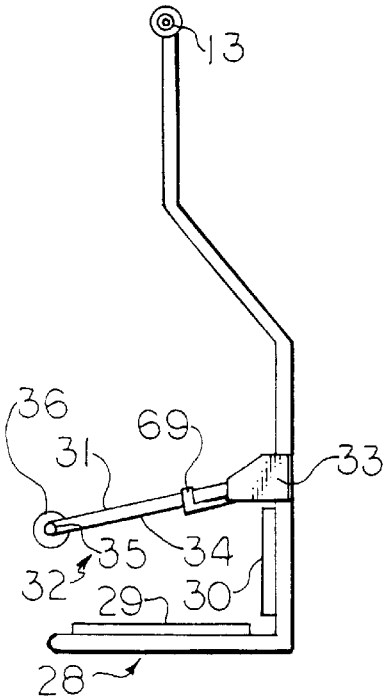
FIG. 10 is a side view of a lift chair of this invention showing a safety bar and a trapeze.
Figure 11:
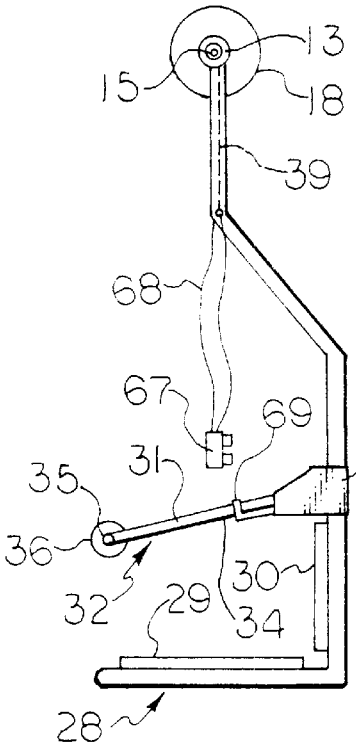
FIG. 11 is a side view of a lift chair of this invention showing a brake assembly, a safety bar and a hanging electrical control.
Figure 12:
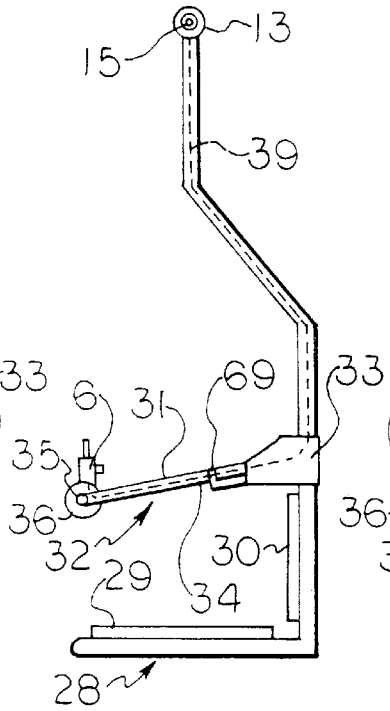
FIG. 12 is a side view of a lift chair of this invention showing the safety bar with the electrical control mounted on the safety bar.
Figure 13:
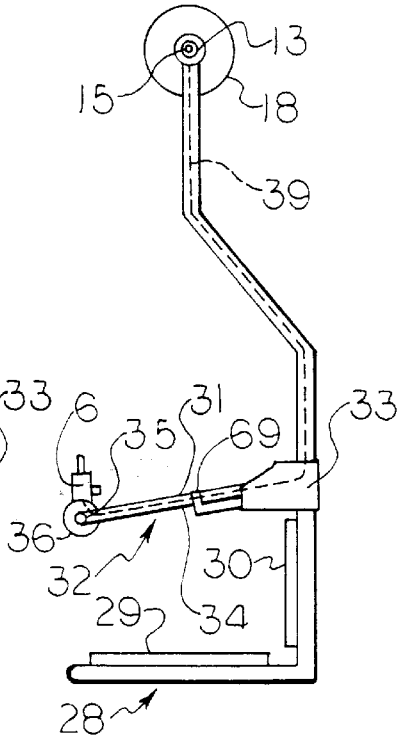
FIG. 13 is a side view of a lift chair of this invention showing the safety bar with the electrical control mounted on the safety bar, and a full brake assembly mounted on the shaft.

The supporting shaft 3 has mounted on it at least one shaft mounted brake 5, and usually, there are two such brakes 5. The shaft mounted brakes 5 are mounted such that the supporting shaft 3 runs through the center of the brake assembly 18, the details of such brake assembly 18, and brake 5 being set forth in FIG. 7.

With specificity, the brake assembly 18 has a housing 19 over it which is generally manufactured from a strong plastic. As can be observed from FIG. 7, this housing assembly is detachedly affixed to the inner face 50 of the second supporting plate 46 by bolts 66 and 66'. This housing assembly helps keep the brake assembly working parts dry as will be discussed infra.

The brake assembly 18, aside from the housing 19 is comprised of an electromagnetic magnet assembly 40, a means of energizing and controlling the electromagnetic magnet 41 (not shown in FIG. 7), a first metal plate 42 having a center opening 43, and a metal bearing 44 having an outside surface 45. In addition, there is a second supporting plate 46, having a center opening 47, the second supporting plate 46 having an outside edge 48, an outer face 49, and inner face 50, and an second opening 51 through it, and located near the outside edge 48.

The first metal plate 42 is fixedly attached to a collar 52, such as by welding at 55. The collar 52 passes through the center opening 43 and is fixedly attached to the supporting shaft 3 at point 53 by keys 54, or the like, such that first metal plate 42 and the collar 52 are securely attached to the supporting shaft 3. The metal bearing 44 is mounted such that it rotates on the surface of the collar 52, and as can be noted, the outside surface 45 of the metal bearing 42 interfaces with the magnet 41. The magnet 41 is rigidly supported on the inner face 50 of the second supporting plate 46 by means of a bolt 56, or the like. The supporting shaft 3 is sealed by watertight seals 57 and 57', at points 58 and 58'.

The second supporting plate 46 is rigidly connected to one of the upwardly extending shafts 8 at about point 59 by a rigid rod 60 which is usually provided by welding 61, although other means may be used. The opposite end of the rod 60 is attached to the second supporting plate 46 in a manner in which the rod 60 is electrically insulated, such as by non-conductive gasketing 62 and a non-conductive sleeve 63 which surrounds the detachable connective bolt or screw 64, the bolt or screw 64 being inserted into the end of the rod 60, and being drawn down tight against the gasketing 62 by means of the internal threads 65 (shown in phantom) in the rod 60.

Thus, the brakes 5 are each attached to one of the upwardly extending shafts 8 at about point 59 to provide a braking mechanism for the lift chair 1.

Returning to FIGS. 1 and 2, there is shown the lift chair 1, in which it can be observed that the lower ends 10 of the upwardly extending shafts 8 are bent such that they form an L-shaped configuration which are then further bent horizontally to meet each other at their terminal ends to complete the formation of the seat support 28. Mounted on the seat support 28 is a seat 29, which can be any material that is able to support an individual and to withstand the water immersion, Such materials are generally polyvinylchloride sheet material. Any suitable means may be used to mount the seat, such as bolts, screws, wires or the like.

The seat 29 is also furnished with a back rest 30, which back rest 30 extends between the two upwardly extending shafts 8, and is affixed therebetween at a convenient height for supporting a person's back, using any suitable form of attachment.

The lift chair 1 also has a safety bar 32 which has a U-shaped configuration and on which switch and control 6 is mounted said safety bar 32 comprising a crossover bar 35 interconnected with two parallel side bars 31 (only one of which is shown in FIG. 3). On each of the ends 34 of the U-shaped configuration is mounted a connector 70 (FIG. 1). Such connector 70 is mounted at a convenient point above the horizontal bar arrangement and is attached to the upwardly extending shafts 8 through the use of a connector housing 33. Since the safety bar 32 is rotatably mounted on the bracket 33, it can be raised over the occupant's head when occupant wishes to leave or move into the lift chair 1. Further, the safety bar 32 has mounted in the middle of the bottom crossover bar 35 of the U-shaped configuration (FIG. 3), a float 36, which keeps the safety bar 32 afloat and within safe reach of the occupant of the lift chair 1 when the lift chair 1 is immersed in a pool, which also provides access by the person to the switch for the lift.

The safety bar 32 of this invention is equipped with a unique connector which allows the safety bar 32 to be attached to the upwardly extending shafts 8 and 8' of the lift chair 1, while allowing for the displacement of the safety bar 32 over the head of the person utilizing the lift chair 1 to allow easy mounting and dismounting by the person, yet provide a displacement action which does not provide for pinch points on the apparatus. The details of the unique connector are provided infra.

To further assist the occupants of the lift chair 1, there is mount on the front 11 of the upwardly extending shafts 8, a U-shaped trapeze bar 37. The upper ends 38 of the trapeze bar provide for the rigid attachment of the trapeze bar 37 to the upwardly extending shafts 8.

Finally, the electrical control 6, which control is electrically attached to the safety brake 5 and the lift 2, is shown in FIG. 3. The control 6 consists of the control box 38 and the electrical leads 39 (shown in phantom internal to shafts 32 and 8). The control 6, usually a button or lever, is linked such that the electrical power for the unit is used to power the brake and the control.

The control is linked to a non-hazard side electrical enclosure, housing the electrical components, including the switch amplifier (not shown) by the electrical interconnecting wires 39. The switch amplifier transfers binary signals from a hazardous location, i.e. a pool area to the non-hazard side. This is usually accomplished through a power transformer (not shown) or contact starter (not shown) that supports or accepts the voltage from the signal generated by pushing the button or lever at the hazardous location. This signal is several volts which is just enough to operate a switching element. A closed switch (not shown) operates a relay or optocoupler which sends the incoming signal back up to an electrical system and causes the lift to function.

Figure 14:
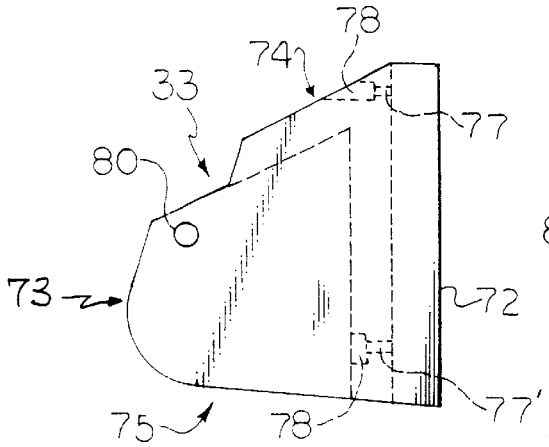
FIG. 14 is a side view of a connector housing of this invention.

Turning now to the new and novel connector 70 which is comprised of two segments, a connector housing 33, and a connector handle 69. The two segments 33 and 69 are movable with regard to each other and with specificity, and with regard to FIG. 14, there is shown an enlarged side view of the connector housing 33. This connector housing 33 is manufactured from tough plastics or metal and is fabricated such that the connector housing 33, has a back end 72, a front end 73, a top 74 and a bottom 75. The back end 72 has a vertical concave surface 76 (FIG. 14) which is designed to adapt to the upwardly extending shafts 8 and 8' in an interfacial mating relationship.

Extending through the concave surface 76 is an opening 77 which allows for the insertion of a bolt (not shown) through the connector housing 33 to enable one to bolt and secure the connector housing 33 to the upwardly extending shaft 8 or 8'.

Figure 15:
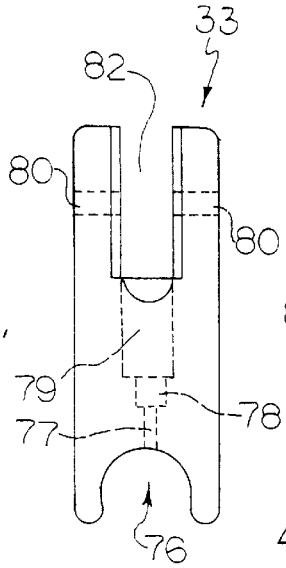
FIG. 15 is a top view of the connector housing of this invention.

There is a similar opening 77' in the connector housing 33, at or near the bottom 75, and in this manner, the connector housing 33 can be securely fastened to the upwardly extending shafts 8 and 8'. It should be noted that there is also provision made for the head of the bolt in opening or pocket 78. Opening 79 allows access to the openings 77 and 78 to place or remove the bolt. The openings 77, 78, and 79 are shown in phantom in FIGS. 14 and 15. There is provided a further opening 80, which opening accommodates an axle 83 (FIG. 18) for the connector handle 69, the collaboration of which will be discussed infra.

Figure 16:
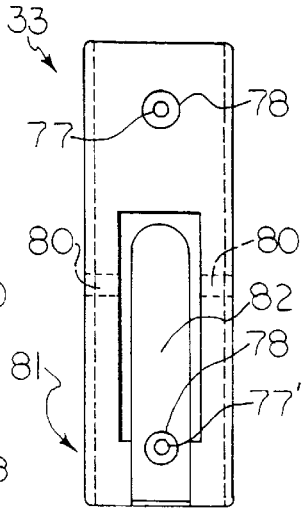
FIG. 16 is an end view of the connector housing of this invention taken from the back end.

As can be observed from FIG. 16, the forward portion 81 of the connector housing 33 has an opening 82 to accommodate a portion of the handle 69, the substance of which will be discussed infra.

Figure 17:
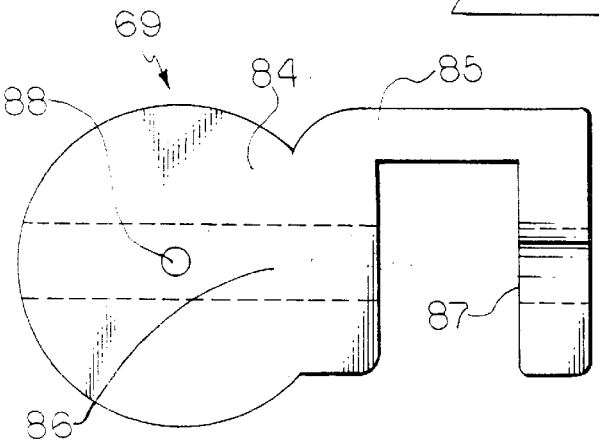
FIG. 17 is a side view of a connector housing of this invention.
Figure 18:
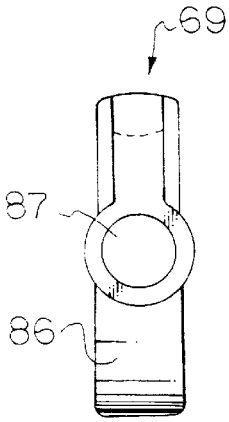
FIG. 18 is an end view of the connector housing of this invention taken from the brace end.

The second part of the connector 70 is the connector handle 69 as shown in FIGS. 17 and 18. In FIG. 17 the connector handle 69 is shown as an integrally connected wheel 84 and brace 85. It will be noted that the wheel 84 and brace 85 are both configured with openings 86 and 87, respectively, (shown in phantom) which are aligned through their long axis centers with each other. These openings 86 and 87 accommodate a common shaft which is, for purposes of illustration, the end of the safety bar 32. The wheel 84 has an opening 88 for an axle 83 which supports the wheel 84 in the forward compartment of the connector housing 33. The opening 88 therefore, aligns with the opening 80 in the connector housing 33 to accommodate the axle 83.

Figure 19:
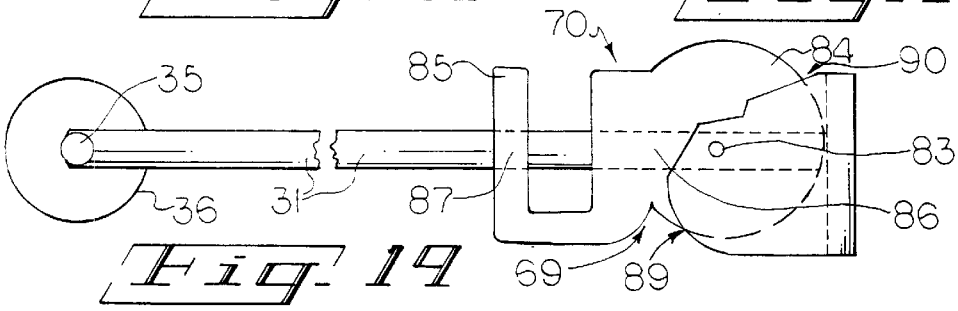
FIG. 19 is a full side view of a connector of this invention showing the connector handle and the connector housing in combination.

Turning now to FIG. 19, which is a full side view of the safety bar 32, there is shown the connector housing 33 and the connector handle 69 in their assembled and operative configuration. The connector handle 69 and the connector housing 33 are held together by the axle 83 around which the wheel 84 rotates when the safety bar 32 is moved.

It should be noted that the configuration of the connector housing 33 and the connector handle 69 is such that it can be rotated over at least 200 degrees without causing a potential pinch point at points 89 or 90. The safety bar 32 can be raised to the highest level necessary for the person using the lift chair to move in and out of the chair without ever approaching a potential pinch point at 90. Further, the safety bar 32 can be in the safety position, that is a floating position, without ever approaching a potential pinch point at 89.

Thus, what has been described is several embodiments of a novel lift chair and a novel connector for connecting a safety bar to said chairs.

What is claimed is:

1. A lift chair, said chair comprising:

a frame, said frame having two spaced-apart, generally upwardly extending shafts, each said shaft having an upper end, a lower end, and a front side;

each said upper end terminating in a tee, each said tee having a top, wherein the top of each tee is a hollow tubular bearing housing with each bearing housing capable of having a tubular bearing retained therein;

a seat;

each lower end of the upwardly extending shafts terminating in a horizontal bar arrangement and being attached to each other at their terminating ends to form a support for the seat surmounted thereon;

a common back support means;

each lower end of the upwardly extending shafts having mounted therebetween, the common back support means attached to their respective front sides;

an electrical control connected to a power cord said electrical control being attached to the upwardly extending shafts by a support cord which support cord and power cord each have a sufficient length to allow a person seated in the seat to use the control.

2. A lift chair as claimed in claim 1 wherein the hollow tubular bearing housing contains a non-conductive tubular bearing therein.

3. A lift chair as claimed in claim 1 wherein the lift chair has additionally mounted on the front face of its respective upwardly extending shafts, a trapeze bar, said trapeze bar having a U-shaped configuration and having upper ends on the U which are rigidly attached to the upwardly extending shafts.

4. A lift chair, said chair comprising:

a frame, said frame having two spaced-apart, generally upwardly extending shafts, each said shaft having an upper end, a lower end, and a front side;

each said upper end terminating in a tee, each said tee having a top, wherein the top of each tee is a hollow tubular bearing housing with each bearing housing capable of having a tubular bearing retained therein;

a common supporting shaft having outer ends which are capable of being rigidly supported, said common supporting shaft extending through and outside the ends of each of the tubular bearing housings;

said support shaft having mounted thereon, at least one shaft mounted brake, said shaft mounted brake comprising the brake assembly comprising:

a housing for the brake assembly, having an outside surface;

an electromagnetic magnet assembly;

a means of energizing and controlling the electromagnetic magnet;

a first metal plate having a center opening;

a metal bearing having an outside surface;

said brake assembly being supported on a second supporting plate, which supporting plate is adapted with a center opening through which the support shaft passes, said second support plate having an outside edge, an outer face and an inner face and having an outside dimension greater than the outside dimension of the brake assembly, said second metal supporting plate having an opening through it near its outside edge;

said first metal plate being fixedly attached to a collar, which collar passes through the center opening in the first metal plate, said collar being fixedly attached to the supporting shaft;

said collar having rotatably mounted thereon, the metal bearing, said metal bearing being surrounded on its outside surface and rotatably interfacing with an electromagnetic magnet, said electromagnetic magnet being rigidly supported on the inner face of the first supporting plate, said supporting shaft being sealed against water penetration at the outer face of the second supporting plate and the outside surface of the brake assembly housing;

said first supporting plate being rigidly connected to an upwardly extending shaft by a connecting rod such that the rod extends between the upwardly extending shaft and the second supporting plate, said rod being affixed to the first supporting plate by a detachable connector, which detachable connector passes through the opening near the outside edge of the second supporting plate and into the rod; said rod and second supporting plate having a non-conductive gasket between them, said detachable connector and said second supporting plate having a non-conductive gasket between them and, said detachable connector being surrounded by a non-conductive sleeve as it passes through the opening near the outside edge of the second supporting plate;

a seat;

each lower end of the upwardly extending shafts terminating in a horizontal bar arrangement and being attached to each other at their terminating ends to form a support for the seat surmounted thereon;

a common back support means;

each lower end of the upwardly extending shafts having mounted therebetween, the common back support means attached to their respective front sides;

an electrical control for controlling the electromagnetic magnet, connected to a power cord said electrical control being attached to the upwardly extending shafts by a support cord which support cord and power cord each have a sufficient length to allow a person seated in the seat to use the control.

5. A lift chair as claimed in claim 4 wherein the hollow tubular bearing housing contains a non-conductive tubular bearing therein.

6. A lift chair as claimed in claim 4 wherein the lift chair has additionally mounted on the front face of its respective upwardly extending shafts, a trapeze bar, said trapeze bar having a U-shaped configuration and having upper ends on the U which are rigidly attached to the upwardly extending shafts.

7. A lift chair, said chair comprising:

a frame, said frame having two spaced-apart, generally upwardly extending shafts, each said shaft having an upper end, a lower end, and a front side;

each said upper end terminating in a tee, each said tee having a top, wherein the top of each tee is a hollow tubular bearing housing with each bearing housing capable of having a tubular bearing retained therein;

the common supporting shaft having outer ends which are capable of being rigidly supported, said common supporting shaft extending through and outside the ends of each of the tubular bearing housings;

said support shaft having mounted thereon, at least one shaft mounted brake, said shaft mounted brake comprising a brake assembly comprising:

a housing for the brake assembly, having an outside surface;

an electromagnetic magnet assembly;

a means of energizing and controlling the electromagnetic magnet;

a first metal plate having a center opening;

a metal bearing having an outside surface;

said brake assembly being supported on a second supporting plate, which supporting plate is adapted with a center opening through which the support shaft passes, said second support plate having an outside edge, an outer face and an inner face and; having an outside dimension greater than the outside dimension of the brake assembly, said second metal supporting plate; having an opening through it near its outside edge;

said first metal plate being fixedly attached to a collar, which collar passes through the center opening in the first metal plate, said collar being fixedly attached to the supporting shaft;

said collar having rotatably mounted thereon, the metal bearing, said metal bearing being surrounded on its outside surface and rotatably interfacing with an electromagnetic magnet, said electromagnetic magnet being rigidly supported on the inner face of the first supporting plate, said supporting shaft being sealed against water penetration at the outer face of the second supporting plate and the outside surface of the brake assembly housing;

said first supporting plate being rigidly connected to an upwardly extending shaft by a connecting rod such that the rod extends between the upwardly extending shaft and the second supporting plate, said rod being affixed to the first supporting plate by a detachable connector, which detachable connector passes through the opening near the outside edge of the second supporting plate and into the rod; said rod and second supporting plate having a non-conductive gasket between them, said detachable connector and said second supporting plate having a non-conductive gasket between them and, said detachable connector being surrounded by a non-conductive sleeve as it passes through the opening near the outside edge of the second supporting plate;

a seat;

each lower end of the upwardly extending shafts terminating in a horizontal bar arrangement and being attached to each other at their terminating ends to form a support for the seat surmounted thereon;

a back support means;

each lower end of the upwardly extending shafts having mounted therebetween, the common back support means attached to their respective front sides;

each said upwardly extending shaft having mounted on its front side, at a convenient point above the horizontal bar arrangement, a bracket, said bracket having rotatably attached thereto, a support handle;

a safety bar, said safety bar having a U-shaped configuration with lower and upper ends, each said upper end being fixedly mounted on each respective support handle, said safety bar having mounted between the lower ends thereof, a float, said float being capable of floating in water and supporting said safety bar;

an electrical control for controlling the electromagnetic magnet, connected to a power cord said electrical control being attached to the upwardly extending shafts by a support cord which support cord and power cord each have a sufficient length to allow a person seated in the seat to use the control.

8. A lift chair as claimed in claim 7 wherein the hollow tubular bearing housing contains a non-conductive tubular bearing therein.

9. A lift chair as claimed in claim 7 wherein the lift chair has additionally mounted on the front face of its respective upwardly extending shafts, a trapeze bar, said trapeze bar having a U-shaped configuration and having upper ends on the U which are rigidly attached to the upwardly extending shafts.

10. A lift chair, said chair comprising:

a frame, said frame having two spaced-apart, generally upwardly extending shafts, each said shaft having an upper end, a lower end, and a front side;

each said upper end terminating in a tee, each said tee having a top, wherein the top of each tee is a hollow tubular bearing housing with each bearing housing capable of having a tubular bearing retained therein;

a seat;

each lower end of the upwardly extending shafts terminating in a horizontal bar arrangement and being attached to each other at their terminating ends to form a support for the seat surmounted thereon;

a common back support means;

each lower end of the upwardly extending shafts having mounted therebetween, the common back support means attached to their respective front sides;

each said upwardly extending shaft having mounted on its front side, at a convenient point above the horizontal bar arrangement, a bracket, said bracket having rotatably attached thereto, a support handle;

a safety bar, said safety bar having a U-shaped configuration with lower and upper ends, each said upper end being fixedly mounted on each respective support handle, said safety bar having mounted between the lower ends thereof, a float, said float being capable of floating in water and supporting said safety bar;

an electrical control attached to the safety bar, said electrical control being capable of being connected electrically with a power source containing control circuitry.

11. A lift chair as claimed in claim 10 wherein the hollow tubular bearing housing contains a non-conductive tubular bearing therein.

12. A lift chair as claimed in claim 10 wherein the lift chair has additionally mounted on the front face of its respective upwardly extending shafts, a trapeze bar, said trapeze bar having a U-shaped configuration and having upper ends on the U which are rigidly attached to the upwardly extending shafts.

13. A lift chair, said chair comprising:

a frame, said frame having two spaced-apart, generally upwardly extending shafts, each said shaft having an upper end, a lower end, and a front side;

each said upper end terminating in a tee, each said tee having a top, wherein the top of each tee is a hollow tubular bearing housing with each bearing housing capable of having a tubular bearing retained therein;

a common supporting shaft having outer ends which are capable of being rigidly supported, said common supporting shaft extending through and outside the ends of each of the tubular bearing housings;

said support shaft having mounted thereon, at least one shaft mounted brake, said shaft mounted brake comprising a brake assembly comprising:

a housing for the brake assembly, having an outside surface;

an electromagnetic magnet assembly;

a means of energizing and controlling the electromagnetic magnet;

a first metal plate having a center opening;

a metal bearing having an outside surface;

said brake assembly being supported on a second supporting plate, which supporting plate is adapted with a center opening through which the support shaft passes, said second support plate having an outside edge, an outer face and an inner face and; having an outside dimension greater than the outside dimension of the brake assembly, said second metal supporting plate; having an opening through it near its outside edge;

said first metal plate being fixedly attached to a collar, which collar passes through the center opening in the first metal plate, said collar being fixedly attached to the supporting shaft;

said collar having rotatably mounted thereon, the metal bearing, said metal bearing being surrounded on its outside surface and rotatably interfacing with an electromagnetic magnet, said electromagnetic magnet being rigidly supported on the inner face of the first supporting plate, said supporting shaft being sealed against water penetration at the outer face of the second supporting plate and the outside surface of the brake assembly housing;

said first supporting plate being rigidly connected to an upwardly extending shaft by a connecting rod such that the rod extends between the upwardly extending shaft and the second supporting plate, said rod being affixed to the first supporting plate by a detachable connector, which detachable connector passes through the opening near the outside edge of the second supporting plate and into the rod; said rod and second supporting plate having a non-conductive gasket between them, said detachable connector and said second supporting plate having a non-conductive gasket between them and, said detachable connector being surrounded by a non-conductive sleeve as it passes through the opening near the outside edge of the second supporting plate;

a seat;

each lower end of the upwardly extending shafts terminating in a horizontal bar arrangement and being attached to each other at their terminating ends to form a support for the seat surmounted thereon;

a common back support means;

each lower end of the upwardly extending shafts having mounted therebetween, the common back support means attached to their respective front sides;

each said upwardly extending shaft having mounted on its front side, at a convenient point above the horizontal bar arrangement, a bracket, said bracket having rotatably attached thereto, a support handle;

a safety bar, said safety bar having a U-shaped configuration with lower and upper ends, each said upper end being fixedly mounted on each respective support handle, said safety bar having mounted between the lower ends thereof, a float, said float being capable of floating in water and supporting said safety bar;

an electrical control for controlling the electromagnetic magnet, attached to the safety bar, said electrical control being capable of being connected electrically with a power source containing control circuitry.

14. A lift chair as claimed in claim 13 wherein the hollow tubular bearing housing contains a non-conductive tubular bearing therein.

15. A lift chair as claimed in claim 13 wherein the lift chair has additionally mounted on the front face of its respective upwardly extending shafts, a trapeze bar, said trapeze bar having a U-shaped configuration and having upper ends on the U which are rigidly attached to the upwardly extending shafts.

16. A lift chair, said chair comprising:

a frame, said frame having two spaced-apart, generally upwardly extending shafts, each said shaft having an upper end, a lower end, and a front side;

each said upper end terminating in a tee, each said tee having a top, wherein the top of each tee is a hollow tubular bearing housing, and each bearing housing contains a first non-conductive tubular bearing being retained therein, each said housing having an outside end;

a common supporting shaft having outer ends which are capable of being rigidly supported, said common supporting shaft extending through and outside the ends of each of the tubular bearing housings;

said support shaft having mounted thereon, at least one shaft mounted brake, said shaft mounted brake comprising a brake assembly comprising:

a housing for the brake assembly, having an outside surface;

an electromagnetic magnet assembly;

a means of energizing and controlling the electromagnetic magnet;

a first metal plate having a center opening;

a metal bearing having an outside surface;

said brake assembly being supported on a second supporting plate which supporting plate is adapted with a center opening through which the support shaft passes, said second support plate having an outside edge, an outer face and an inner face and having an outside dimension greater than the outside dimension of the brake assembly, said second metal supporting plate having an opening through it near its outside edge;

said first metal plate being fixedly attached to a collar, which collar passes through the center opening in the first metal plate, said collar being fixedly attached to the supporting shaft;

said collar having rotatably mounted thereon, the metal bearing, said metal bearing being surrounded on its outside surface and rotatably interfacing with an electromagnetic magnet, said electromagnetic magnet being rigidly supported on the inner face of the first supporting plate, said supporting shaft being sealed against water penetration at the outer face of the second supporting plate and the outside surface of the brake assembly housing;

said first supporting plate being rigidly connected to an upwardly extending shaft by a connecting rod such that the rod extends between the upwardly extending shaft and the second supporting plate, said rod being affixed to the first supporting plate by a detachable connector, which detachable connector passes through the opening near the outside edge of the second supporting plate and into the rod; said rod and second supporting plate having a non-conductive gasket between them, said detachable connector and said second supporting plate having a non-conductive gasket between them and, said detachable connector being surrounded by a non-conductive sleeve as it passes through the opening near the outside edge of the second supporting plate;

a seat;

each lower end of the upwardly extending shafts terminating in a horizontal bar arrangement and being attached to each other at their terminating ends to form a support for the seat surmounted thereon;

a common back support means;

each lower end of the upwardly extending shafts having mounted therebetween, the common back support means attached to their respective front sides;

each said upwardly extending shaft having mounted on its front side, at a convenient point above the horizontal bar arrangement, a bracket, said bracket having rotatably attached thereto, a support handle;

a safety bar, said safety bar having a U-shaped configuration with lower and upper ends, each said upper end being fixedly mounted on each respective support handle, said safety bar having mounted between the lower ends thereof, a float, said float being capable of floating in water and supporting said safety bar;

a trapeze bar, said trapeze bar having a U-shaped configuration and having upper ends on the U, each said upper end being rigidly mounted on the front face of its respective upwardly extending shaft;

an electrical control attached to the safety bar, said electrical control for controlling the electromagnetic magnet, being connected electrically with said brake to control the start and stop of said brake.

17. A connector, said connector comprising in combination the connector handle;

a connector housing, and an axle;

said connector handle comprising a wheel, said wheel having an outside edge and a center hole, and a brace;

said brace having a front end and a back end and having essentially a U-shaped configuration;

said brace being integrally connected at the back end with a portion of the outside edge of the wheel;

said wheel having an elongated opening therethrough which has a center axis, which opening extends from the outside edge of the wheel essentially at the point where the brace is connected to the wheel, to the opposite outside edge of the wheel;

said brace having an elongated opening therethrough having a center axis, said opening extending from the front end of the brace through the back end of the brace;

said elongated openings being aligned through their center axis and said elongated openings being capable of receiving a common shaft therein;

said connector housing having a forward hollow compartment with a top edge, a solid back end, and separated side walls;

said solid back end having a vertical concave surface to allow for mating with a vertical shaft;

said solid back end having at least one opening therethrough to accommodate a fastener for fastening the connector housing to said shaft;

said forward compartment having circular openings through the side walls near the top edge, which circular openings are in alignment with each other;

said connector handle and said connector housing being rotatably mounted with one another by inserting the wheel into the forward compartment between the separated side walls and aligning the center hole of the wheel with the circular opening of the connector housing and inserting the axle through said circular openings and center hole.

18. A connector handle, said connector handle comprising:

a wheel, said wheel having an outside edge and a center hole;

a brace;

said brace having a front end and a back end and having essentially a U-shaped configuration;

said brace being integrally connected at the back end with a portion of the outside edge of the wheel;

said wheel having an elongated opening therethrough which has a center axis, which opening extends from the outside edge of the wheel essentially at the point where the brace is connected to the wheel, to the opposite outside edge of the wheel;

said brace having an elongated opening therethrough having a center axis, said opening extending from the front end of the brace through the back end of the brace;

said elongated openings being aligned through their center axis and said elongated openings being capable of receiving a common shaft therein;

said connector housing having a forward hollow compartment with a top edge, a solid back end, and separated side walls;

said solid back end having a vertical concave surface to allow for mating with a vertical shaft;

said solid back end having at least one opening therethrough to accommodate a fastener for fastening the connector housing to said shaft;

said forward compartment having circular openings through the side walls near the top edge, which circular openings are in alignment with each other.

19. A connector housing, said connector housing comprising:

a forward hollow compartment with a top edge, a solid back end, and separated side walls;

said solid back end having a vertical concave surface to allow for mating with a vertical shaft;

said solid back end having at least one opening therethrough to accommodate a fastener for fastening the connector housing to said shaft;

said forward compartment having circular openings through the side walls near the top edge, which circular openings are in alignment with each other.

* * * * *